US007052548B2

(12) United States Patent
Jones

(10) Patent No.: US 7,052,548 B2
(45) Date of Patent: May 30, 2006

(54) ANGLED MANIFOLD AND DISPENSING APPARATUS

(75) Inventor: Kenneth Jones, Marietta, GA (US)

(73) Assignee: Nordson Corporation, Westlake, OH (US)

( * ) Notice: Subject to any disclaimer, the term of this patent is extended or adjusted under 35 U.S.C. 154(b) by 44 days.

(21) Appl. No.: 10/831,067

(22) Filed: Apr. 22, 2004

(65) Prior Publication Data

US 2005/0235909 A1 Oct. 27, 2005

(51) Int. Cl.
*B05B 7/16* (2006.01)

(52) U.S. Cl. ..... 118/302; 239/135

(58) Field of Classification Search ..... 118/300, 118/302, 313; 239/135, 292, 290–291; 222/318, 222/146.2; 425/72.1
See application file for complete search history.

(56) References Cited

U.S. PATENT DOCUMENTS 5,000,112 A * 3/1991 Rothen et al. ..... 118/411
5,478,224 A * 12/1995 McGuffey ..... 425/7
6,089,413 A * 7/2000 Riney et al. ..... 222/318

* cited by examiner

*Primary Examiner*—Chris Fiorilla
*Assistant Examiner*—Yewebdar Tadesse
(74) *Attorney, Agent, or Firm*—Wood, Herron & Evans, L.L.P.

(57) ABSTRACT

An apparatus for dispensing a liquid onto a substrate including a horizontally-oriented manifold body having spaced apart front and rear surfaces and a lower surface extending between the front and rear surfaces. The lower surface is adapted to overlie at least a portion of the substrate. At least one dispensing module is mounted on the front surface of the manifold body and includes a discharge end for dispensing liquid onto the substrate. The discharge end is positioned proximate the lower edge of the front surface and the forward edge of the lower surface. The lower surface of the manifold body is angled in an upward direction generally from the front edge to the rear edge to progressively increase the distance between the lower surface and the substrate from front to rear when the front surface is vertically oriented and the substrate is horizontally oriented beneath the manifold body. The angled lower surface also facilitates substrates approaching the apparatus at a similar angle.

7 Claims, 4 Drawing Sheets

ANGLED MANIFOLD AND DISPENSING APPARATUS

FIELD OF THE INVENTION

The present invention generally relates to liquid material dispensing systems, and more specifically to applicators for dispensing a liquid material onto a substrate.

BACKGROUND OF THE INVENTION

Various liquid dispensing systems have been developed for the precise application of a heated liquid onto a substrate. Dispensing systems for supplying liquid material in the form of filaments or other patterns are known in the art. These dispensing systems are conventionally used to apply thermoplastic materials, such as a hot melt adhesive, to various substrate materials during the manufacturing of diapers, sanitary napkins, surgical drapes, and other products. Typically, liquid material and pressurized process air are supplied to the dispensers where they are heated and distributed to one or more dispensing modules for application to the substrate. The heated liquid material is discharged from the dispensing module while heated pressurized process air is directed toward the dispensed liquid to attenuate or draw down the dispensed liquid material and to control the pattern of the liquid material as it is applied to the substrate.

Conventional liquid dispensing systems, shown schematically in FIG. 3, typically utilize a manifold for heating and distributing the pressurized air and liquid material to the dispensing modules. The manifold generally has a block configuration having a pair of opposed front and rear surfaces, a pair of opposed end surfaces, and opposed upper and lower surfaces. The manifold is configured to accommodate a number of dispensing modules that releasably couple to the manifold typically along the front surface. The dispensing module includes a liquid inlet and a process air inlet that communicate with a liquid outlet and process air outlet in the manifold. The dispensing module further includes a pneumatically or electrically actuated valve assembly for metering a precise quantity of the liquid and discharging the metered amount through a small-diameter dispensing orifice and onto a moving substrate positioned below the orifice. The dispensing end is generally adjacent the lower surface of the manifold. To increase liquid deposition control and accuracy, it is desirable to minimize the distance between the substrate and the dispensing end of the modules. As a result, the distance between the manifold and the substrate passing beneath the manifold is generally small. The distance between the lower surface of the manifold and substrate in conventional liquid dispensing systems, however, have some drawbacks.

One drawback is that the heaters in the manifold that heat the liquid and process air make the manifold, including the lower surface, very hot. This in turn heats the substrate as it passes underneath the manifold. The heating of the substrate may affect the thermal and structural properties of the substrate material, such as, for example, by weakening it. Moreover, heating the substrate may increase the curing time of the deposited liquid thereby affecting subsequent manufacturing steps, or may affect the spreading of the deposition pattern on the substrate, thereby depositing liquid where none is desired or possibly permitted, depending on the particular application.

Another drawback is that in some applications, such as when applying elastic strands onto a substrate, the angle at which the strands are fed toward the dispensing modules affects the coating of the strands as they pass by the dispensing orifice. In conventional dispensing systems, the manifold limits the angle at which the strands approach the dispensing orifice thus affecting coating efficiency of the strands. Yet another drawback is that servicing the substrate and the dispensing modules can be difficult in current dispensing systems. For instance, it can often be difficult to align or adjust the substrate, especially on that portion of the substrate directly beneath the manifold without contacting the heated manifold. Additionally, when servicing the dispensing modules a drip pan is typically used to drain the module so as to prevent any liquid from dripping onto the substrate. This may require that the dispensing modules be raised away from the substrate thereby disturbing the desired and established deposition height and deposition pattern.

A need therefore exists for an improved liquid material dispensing system which overcomes various drawbacks of prior dispensing systems, such as those described above.

SUMMARY OF THE INVENTION

The present invention provides an apparatus for dispensing a liquid onto a substrate. To this end, the apparatus includes a horizontally-oriented manifold body having spaced apart front and rear surfaces and a lower surface extending between the front and rear surfaces. The lower surface is adapted to overlie at least a portion of the substrate. At least one dispensing module is mounted on the front surface of the manifold body and includes a discharge end for dispensing liquid onto the substrate. The discharge end is positioned proximate the lower edge of the front surface and the forward edge of the lower surface. At least a substantial portion of the lower surface of the manifold body is angled in an upward direction from a location proximate the lower edge of the front surface to a location proximate the lower edge of the rear surface to progressively increase the distance between the lower surface and the substrate from front to rear when the front surface is vertically oriented and the substrate is horizontally oriented beneath the manifold body. The manifold body may include non-angled front and/or rear lower surface portions with the angled portion adjacent or intermediate the non-angled portion(s). The lower surface may be angled between approximately 10 degrees and approximately 45 degrees, but is preferably angled at approximately 30 degrees.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
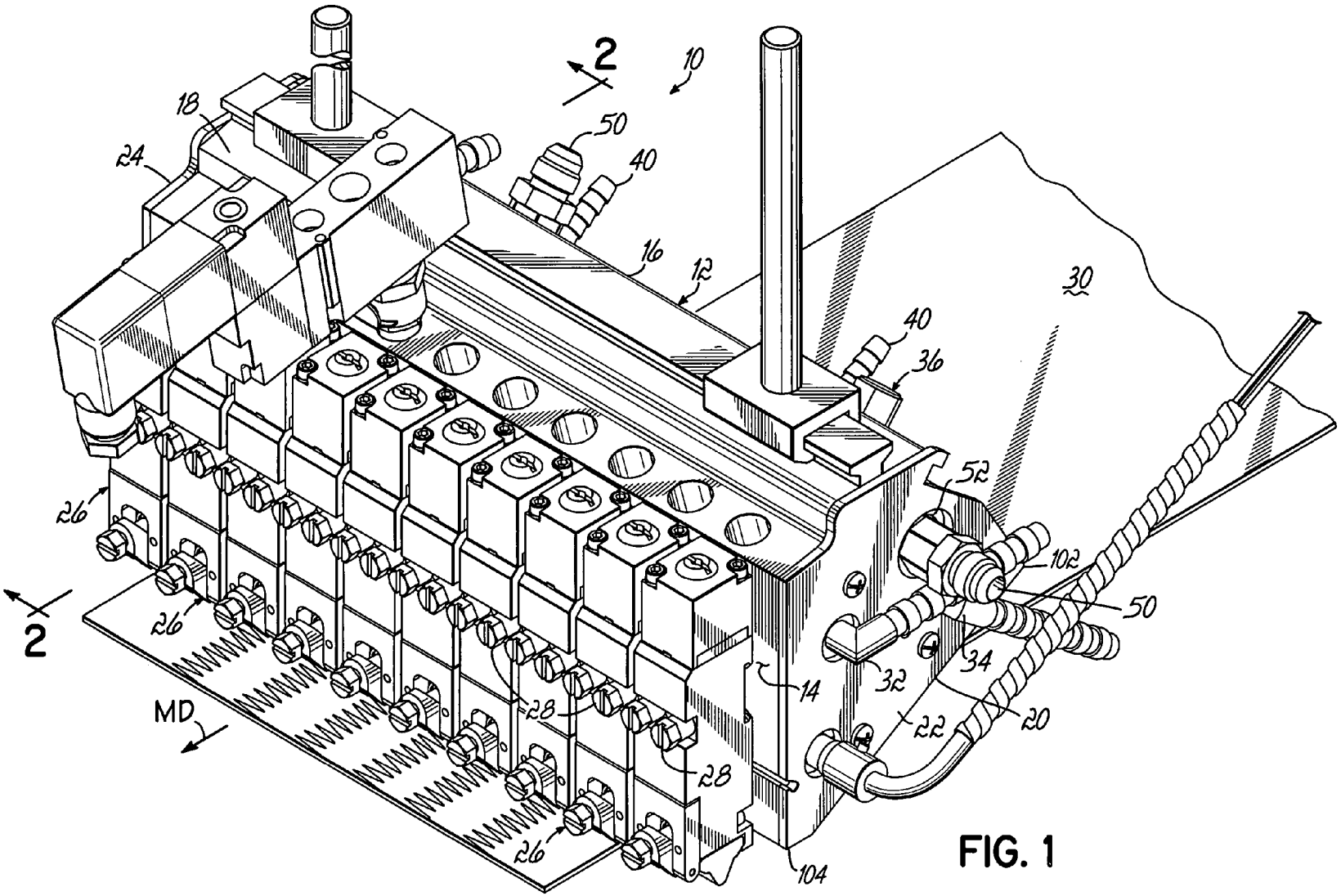
FIG. 1 is a perspective view of an exemplary liquid dispenser of the present invention.

Referring to FIG. 1, there is shown an exemplary liquid material dispensing system 10 according to the present invention. The liquid material dispenser 10 includes a unitary manifold body 12 which has been formed and machined to accommodate the various components of the liquid dispensing system, as will be described more fully below. The manifold body 12 has oppositely disposed front and rear surfaces 14, 16, oppositely disposed upper and lower surfaces 18, 20, and oppositely disposed end surfaces 22, 24.

Several liquid dispensing modules 26 are secured to the front surface 14 of the manifold body 12 by fasteners 28. The dispensing modules 26 may be on/off-type modules with internal valve structure (FIG. 2) for selectively dispensing liquid material in the form of one or more filaments or beads. An exemplary module of this type is disclosed in U.S. Pat. No. 6,089,413, commonly assigned to the assignee of the present invention and incorporated herein by reference in its entirety.

Liquid material, such as hot melt adhesive, and pressurized process air are supplied to the individual modules 26 through the manifold body 12 to thereby dispense beads or filaments of the liquid material onto a substrate 30. The substrate 30 is positioned along a moving conveyor system (not shown) that passes the substrate 30 beneath the lower surface 20 of the manifold body 12 and the dispensing modules 26 in a machine direction as indicated by the arrow. The substrate may have a panel configuration so as to span the length of the manifold body, as shown in FIG. 1. The invention, however, is not so limited and, as is known by those skilled in the art, the substrate may generally be any material to which an adhesive is to be applied including, for example, individual elastic strands. The dispenser 10 further includes liquid material heaters 32 and process air heaters 34 for heating the process air and liquid material. Filters 36 are installed in the manifold body 12 to filter out contaminants from the liquid material supplied to the modules 26.

Figure 2:
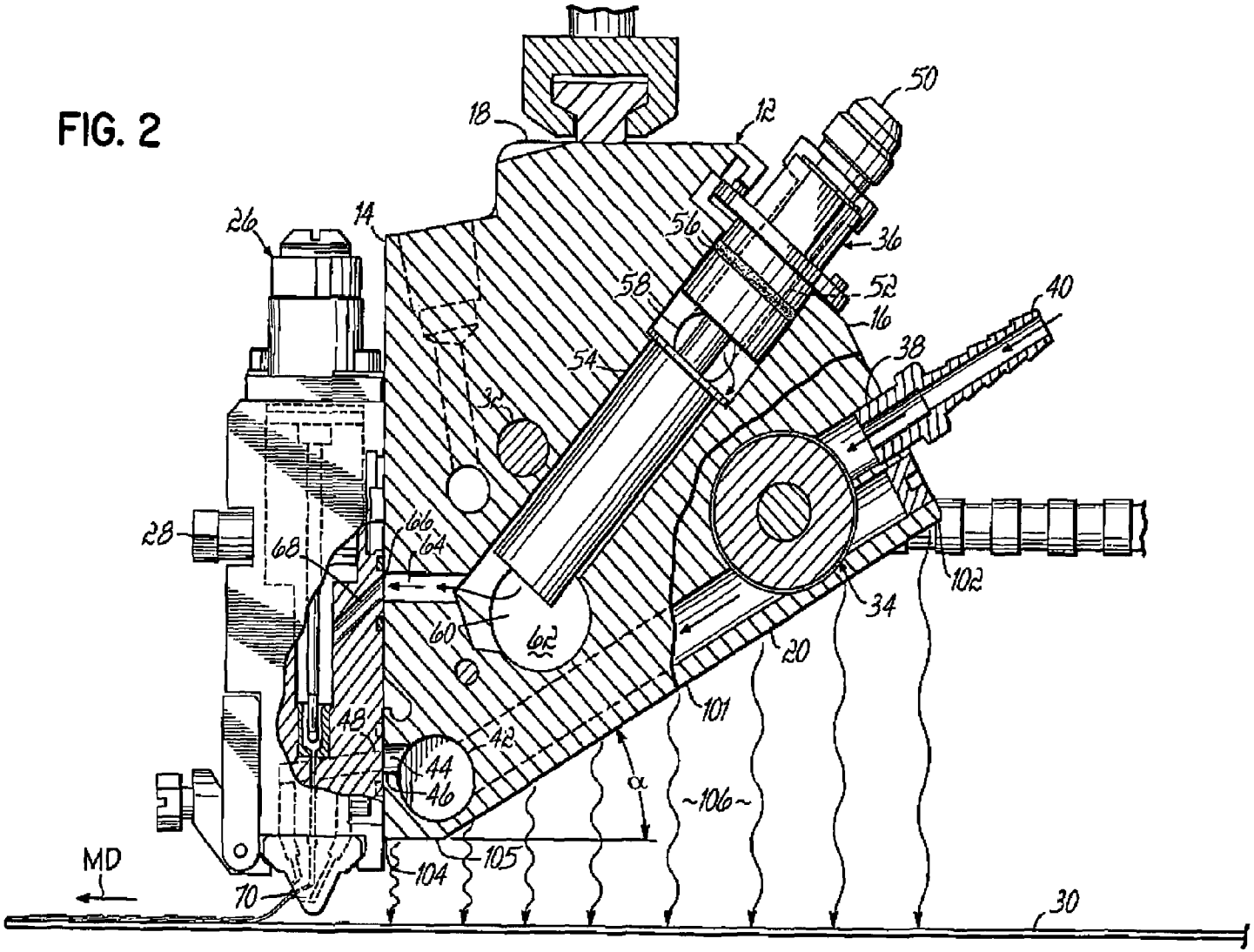
FIG. 2 is a cross-sectional view of the liquid dispenser of FIG. 1 taken along line 2—2.

Referring now to FIG. 2, there is shown a cross-sectional view of the liquid dispenser 10 of FIG. 1. Process air is supplied to the dispenser 10 from a source of pressurized air (not shown) and is routed to the individual modules 26 through a series of interconnected passages. Process air enters the dispenser 10 through an air inlet port 38 formed in the rear surface 16 of the manifold body 12. A fitting 40 coupled to the air inlet port 38 facilitates the attachment of an air line connected to the pressurized air source. The process air is heated by heater 34, such as that described in co-pending U.S. patent application Ser. No. 10/830,613, filed on May 22, 2004 and assigned to the assignee of the present invention. After being heated, the process air enters a distribution passage 42 extending through the manifold body 12 and along the direction parallel to the bank of liquid dispensing modules 26. A plurality of air outlet passages 44 are formed in the front surface 14 of the manifold body 12 and intersect the air distribution passage 42 whereby process air may be provided from the air distribution passage 42 through the outlet passages 44 to each module 26 secured to the front surface 14 of the manifold body 12. The outlet passages 44 terminate at process air outlets 46 in the front surface 14 of manifold body 12. Each module 26 includes a process air inlet 48 which confronts and communicates with the process air outlet 46 when the dispensing modules 26 are secured to the front surface 14 of the manifold body 12.

With continued reference to FIG. 2, liquid material is supplied to the manifold body 12 through a fitting 50 coupled to a liquid material inlet port 52 at the rear surface 16 and/or side surface 22 of the manifold body 12. The liquid inlet port 52 leads to a filter cavity 54 formed in the rear surface 16 of the manifold body 12 and sized to receive a filter 36 for removing contaminants from the incoming liquid material. The filter 36 has an O-ring 56 to seal the upper end of the cavity 54. The filter 36 depicted in this embodiment is more fully shown and described in co-pending U.S. patent application Ser. No. 10/831,016, filed on May 22, 2004 and assigned to the assignee of the present invention. Liquid material enters the filter 36 through circumferentially spaced inlets 58 and circulates through the filter 36 whereafter filter liquid material exits toward the bottom 60 of the filter cavity 54. Thereafter, the liquid material enters a liquid distribution passage 62 communicating with the filter cavity 54 and extending longitudinally along the manifold body 12, adjacent the bank of liquid dispensing modules 26 and generally parallel to the process air distribution passage 42. A plurality of liquid outlet passages 64 are formed into the manifold body 12 from the front surface 14 and intersect the liquid distribution passage 62 where by liquid material flows from the liquid distribution passage 62, through the liquid outlet passages 64 and to each of the dispensing modules 26 mounted on the front surface 14 of the manifold body 12. The liquid outlet passages 64 terminate at liquid outlets 66 in the front surface 14 of the manifold body 12. Each module 26 includes a liquid inlet 68 which confronts and communicates with the liquid outlet 66 when the dispensing modules 26 are secured to the front surface 14 of the manifold body 12. As more fully described in co-pending U.S. patent application Ser. No. 10/830,613, as the liquid flows through the liquid passageways, including passageways 54, 62, 64, the liquid is heated by liquid heater 32. The liquid material travels through various liquid passages formed in dispensing modules 26 and is discharged from one or more liquid discharge orifices 70 in dispensing module 26, as is known in the art.

Figure 3:
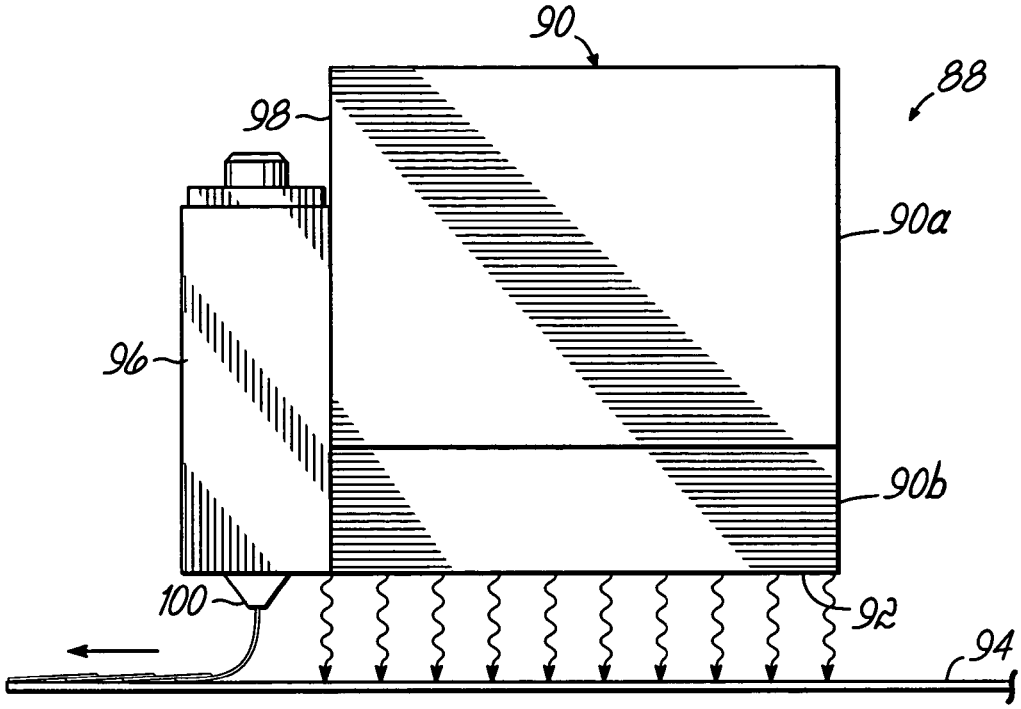
PRIOR ART FIG. 3
FIG. 3 is a schematic view of a prior art liquid dispenser.

As previously discussed, the process air and liquid are heated by heaters 32, 34 in the manifold body 12 before being fed to the dispensing modules 26. These heaters 32, 34 are often high power heaters and as a result cause the various surfaces of the manifold body 12 to become hot. As shown schematically in FIG. 3, prior art dispensing systems 88 typically have a manifold body 90 having a liquid distribution portion 90*a* and a process air distribution portion 90*b*, positioned below the liquid distribution portion 90*a*. The manifold body 90 has a lower surface 92 that confronts the substrate 94 and runs generally parallel to the substrate 94 as it passes beneath the manifold 90 and one or more dispensing modules 96 along a front surface 98 of the manifold body 90. The dispensing end 100 of the dispensing modules 96 is typically adjacent the lower surface 92. In order to control the accuracy of the deposited liquid onto the substrate 94, the dispensing end 100 is positioned adjacent the substrate 94. As a result, the lower surface 92 of the manifold body 90 is also positioned adjacent the substrate 94. The hot lower surface 92 then heats the substrate 94 as it passes under the manifold body 90, which may lead to several undesirable results, as previously discussed.

As most clearly shown in FIG. 2, the present invention includes a lower surface 20 having at least a substantial portion 101 that is angled in an upward direction. The lower surface 20 may be angled in the upward direction from a front intersecting edge 104 of the lower edge of front surface 14 and the front edge of lower surface 20 to a rear intersecting edge 102 of the lower edge of rear surface 16 and the rear edge of lower surface 20. Alternately, the lower surface 20 may include non-angled front and/or rear portions with the angled portion 101 adjacent or intermediate the non-angled portion(s). For instance, as shown in FIG. 2, lower surface 20 includes non-angled front portion 105 adjacent front intersecting edge 104 such that the angled portion 101 starts proximate the front surface 14. In this way, the distance between the lower surface 20 and substrate 30 progressively increase from front to rear such that the intersecting edge 102 is above the intersecting edge 104 to create an open cavity 106. When substrate 30 is fed beneath the manifold body 12, such as along a horizontal plane, the distance between the substrate 30 and intersecting edge 104 is at a first distance and the distance between the substrate 30 and intersecting edge 102 is a second distance greater than the first distance. The increased distance between the lower surface 20 of the manifold body 12 and the substrate 30 reduces the heating of the substrate 30 by the manifold body 12. Furthermore, the open cavity 106 permits increased air flow beneath the manifold body 12, further reducing the effects of manifold heating on the substrate 30. The lower surface 20 may be angled between approximately 10 degrees and approximately 45 degrees, but is preferably angled at approximately 30 degrees.

Figure 4:
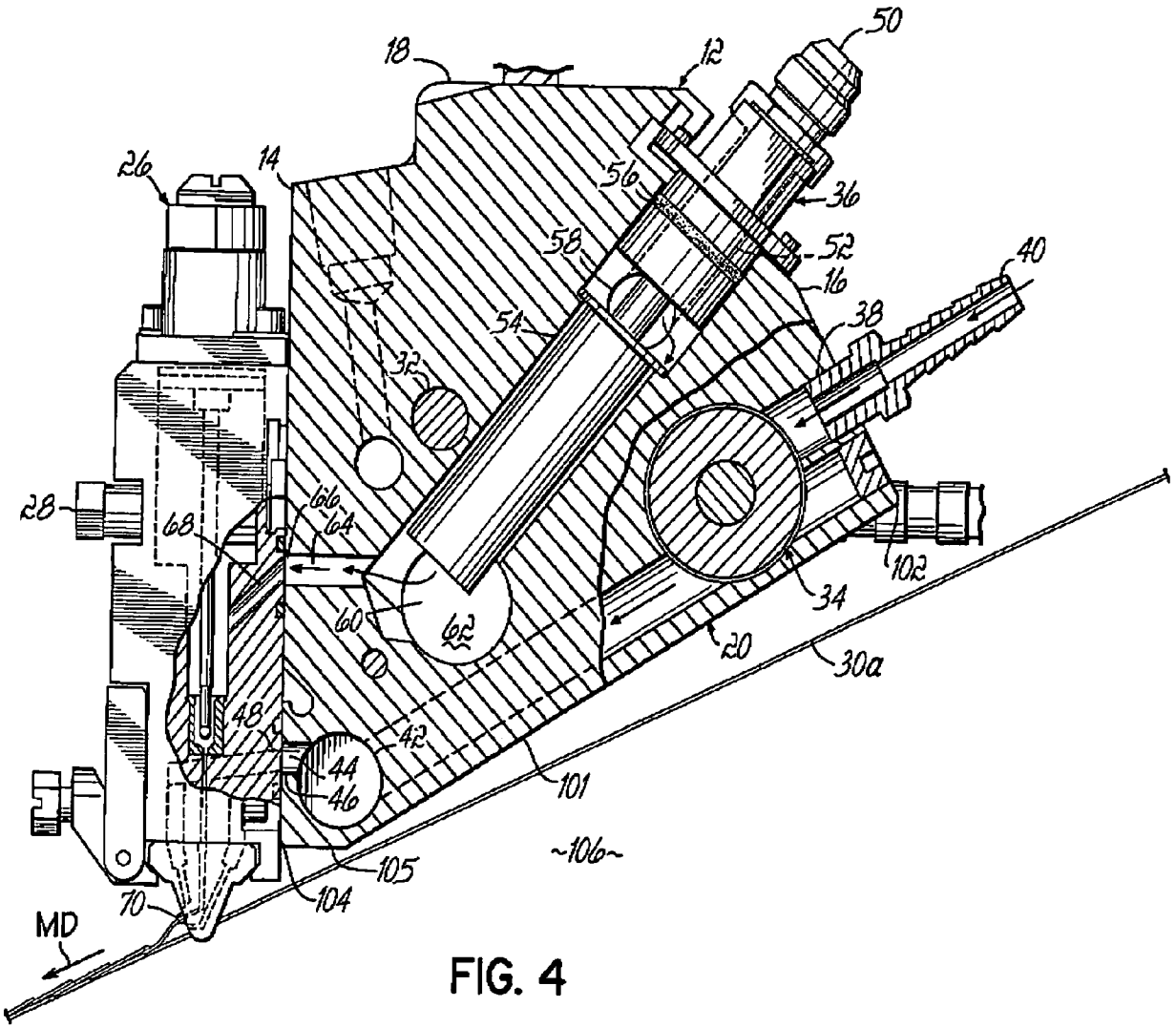
FIG. 4 is a cross-section view similar to FIG. 2 showing the substrate being angled.

As shown in FIG. 4, the open cavity 106 created by angling the lower surface 20 of the manifold body 12 allows the substrate 30(*a*) to be moved past the dispensing modules 26 at an angle. This may be advantageous in some applications, such as when coating LYCRA strands using the V-notch dispensing module. In these applications, the angle at which the substrate 30(*a*) approaches and moves past the dispensing modules 26 affects the efficient coating of the substrate with the liquid. As shown in FIG. 4, the manifold body 12 of the present invention, having the angled lower surface 20, permits the substrate 30(*a*), such as LYCRA strands, to pass by the dispensing modules 26 at an angle. For instance, the substrate 30(*a*) may approach the dispensing modules 26 so as to be generally parallel to the lower surface 20 of the manifold body 12.

The open cavity 106 created by angling the lower surface 20 of the manifold body 12 has additional advantages. For instance, maintenance personnel now have increased access to the substrate 30 beneath the manifold body 12. Thus if the substrate 30 requires aligning or other adjustments, one could access the substrate 30 beneath the manifold body 12 to perform the desired procedure while avoiding inadvertent contact with the manifold body 12. Moreover, once production has begun, it is undesirable to move the manifold/dispensing module applicator relative to the substrate 30, as this may affect the established deposition height, pattern and the repeatability of the deposition process. During maintenance of the dispensing modules 26, the modules 26 are drained of liquid as they are being removed from the manifold body 12. To do this without dripping any liquid on the substrate 30, a drip pan (not shown) is typically used. In prior dispensing systems, such as that shown in FIG. 3, it is often difficult to get the drip pan under the dispensing module 96, thus necessitating the movement of the applicator relative to the substrate 94. In the present invention, however, the open cavity 106 permits increased access to the dispensing modules 26 so as to position a drip pan beneath the modules 26 without disturbing the applicator/substrate relative positions.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. An apparatus for dispensing a liquid onto a substrate, comprising:

a horizontal-oriented unitary manifold body having spaced apart front and rear surfaces and a lower surface extending between said front and rear surfaces, said lower surface adapted to overlie at least a portion of the substrate;

a heater positioned within said manifold body and adjacent said lower surface; and at least one dispensing module mounted on said front surface and having a discharge end for dispensing the liquid onto the substrate, said discharge end positioned proximate to a lower edge of said front surface and a front edge of said lower surface;

at least a substantial portion of said lower surface angling in an upward direction from a location proximate said lower edge of said front surface to a location proximate a lower edge of said rear surface to progressively increase the distance between said lower surface and the substrate from front to rear when said front surface is oriented vertically and the substrate is oriented horizontally beneath said manifold body.

2. The apparatus of claim 1, wherein said lower surface is angled in an upward direction between approximately 10 degrees and approximately 45 degrees relative to a plane perpendicular to said front surface.

3. The apparatus of claim 2, wherein said lower surface is angled in an upward direction at approximately 30 degrees relative to a plane perpendicular to said front surface.

4. A manifold configured to distribute liquid and process air to a dispensing module, comprising:

a horizontally-oriented manifold body having spaced apart front and rear surfaces and a lower surface extending between said front and rear surfaces, said lower surface adapted to overlie at least a portion of a substrate, said front surface configured to carry at least one dispensing module;

at least a substantial portion of said lower surface angling in an upward direction from a location proximate a lower edge of said front surface to a location proximate a lower edge of said rear surface to progressively increase the distance between said lower surface and the substrate from front to rear when said front surface is oriented vertically and the substrate is oriented horizontally beneath said manifold body; and a process air path located in said manifold body adjacent and along said lower surface.

5. The manifold of claim 4, wherein said lower surface is angled in an upward direction between approximately 10 degrees and approximately 45 degrees relative to a plane perpendicular to said front surface.

6. The manifold of claim 5, wherein said lower surface is angled in an upward direction at approximately 30 degrees relative to a plane perpendicular to said front surface.

7. The manifold of claim 4, wherein said manifold body further comprises:

a heater positioned within said process air path and adjacent said rear surface.

* * * * *